US005344257A

United States Patent [19]

Wright et al.

[11] Patent Number: 5,344,257

[45] Date of Patent: Sep. 6, 1994

[54] MINE ROOF EXPANSION ANCHOR AND BAIL ELEMENT

[75] Inventors: Raymond L. Wright, Syracuse; Carl A. Clark, Liverpool, both of N.Y.

[73] Assignee: The Eastern Company, Naugatuck, Conn.

[21] Appl. No.: 984,498

[22] Filed: Dec. 2, 1992

[51] Int. Cl.[5] ..... E21D 20/00

[52] U.S. Cl. ..... 405/259.4; 405/259.1; 411/65; 411/67

[58] Field of Search ..... 405/259.1-259.6; 411/63, 64, 65-68, 72

[56] References Cited

U.S. PATENT DOCUMENTS

| | | | |
|---|---|---|---|
| 2,799,201 | 7/1957 | Genter | 411/67 |
| 3,726,181 | 4/1973 | Dickow et al. | 411/67 X |
| 3,896,627 | 7/1975 | Brown | 405/259.6 |
| 3,941,028 | 3/1976 | Lobello et al. | 411/72 |
| 4,437,795 | 3/1984 | White . | |
| 4,483,645 | 11/1984 | White et al. . | |
| 4,516,886 | 5/1985 | Wright . | |
| 4,556,344 | 12/1985 | White . | |
| 5,018,908 | 5/1991 | Laphon | 411/67 |
| 5,028,188 | 7/1991 | Prince | 411/67 |

FOREIGN PATENT DOCUMENTS

| | | | |
|---|---|---|---|
| 2434502 | 1/1976 | Fed. Rep. of Germany | 411/68 |
| 1128024 | 8/1956 | France | 411/64 |

*Primary Examiner*—Randolph A. Reese
*Assistant Examiner*—John Ricci
*Attorney, Agent, or Firm*—Charles S. McGuire

[57] ABSTRACT

A bail element (10) having a medial portion (12) with a pair of legs (14, 16) extending integrally therefrom and a mechanical expansion anchor having a pair of shell halves (68, 70) and tapered plug (80) held in assembled relation by the bail. The bail legs are identical to one another and, prior to assembly with the shell halves and plug, have three distinct, linear portions (46, 48, 50) respectively extending at preferred angles of about 10°, 36° and 12.5° with respect to lines parallel to the bail centerline (A—A). The bail medial portion includes a pair of upstanding portions shown in a first embodiment (34, 36) and a second embodiment (54, 56) for puncturing a resin cartridge which may be installed with the anchor.

29 Claims, 3 Drawing Sheets

MINE ROOF EXPANSION ANCHOR AND BAIL ELEMENT

BACKGROUND OF THE INVENTION

The present invention relates to mine roof expansion anchors, and more specifically to novel bail elements for retaining tapered plug and shell portions in assembled relation prior to installation, and to anchors incorporating such bail elements.

Among the most common means of supporting the roofs and stabilizing and reinforcing rock strata in underground mines is an elongated rod having a threaded end anchored firmly in a drill hole in the rock formation by a mechanical expansion anchor. Such anchors include a radially expansible shell, a tapered nut or camming plug having a threaded bore for engagement with the threaded end of the rod and, in some cases, a strap or bail element for maintaining the shell and plug in assembled relation prior to installation. The shell may be of unitary design, having a plurality of leaves or fingers extending integrally from an annular base portion, or may include two or more physically separate portions connected via the bail.

The prior art includes many examples of expansion anchor bail structures which, in most cases, comprise a medial portion positioned over the larger diameter end of the plug and a pair of legs extending integrally from the medial portion to terminal ends permanently attached or otherwise secured with respect to the shell. Bails are usually fabricated from elongated strips of somewhat springy sheet metal having a width and thickness adequate to provide the necessary degree of rigidity. Examples of prior art bail structures may be found in U.S. Pat. Nos. 4,483,645, 4,516,886, 4,556,344 and 5,219,248 among others.

Among the requirements of a satisfactory bail element is the retention of the plug in predetermined relation to the shell and, after the anchor is engaged with the bolt and inserted in the drill hole, in a desired relation to the bolt and walls of the hole. Also, since expansion anchors are often installed in combination with a resin grouting material, it is desirable that the bail include structure or configuration which facilitates breaking the cartridge in which the components of the grouting mix are normally packaged.

The principal object of the present invention to provide a bail element of novel and improved configuration for retaining plug and shell portions of a mine roof expansion anchor in predetermined, assembled relation prior to installation.

Another object is to provide a mine roof expansion anchor having a bail element of novel configuration with enhanced capability of breaking the covering of a two-compartment resin cartridge which is inserted in the drill hole ahead of the anchor.

A further object is to provide a mine roof expansion anchor consisting of shell, plug and bail portions wherein the configuration of bail serves to maintain the shell and plug in a desired, assembled relation, and to assist in breaking a resin cartridge installed with the anchor, both in a novel and improved manner.

SUMMARY OF THE INVENTION

The present invention is incorporated in an expansion anchor of the type having a shell portion made up of two physically separate halves, each attached to a respective one of the bail legs. The configurations of both the shell and plug portions are conventional. In the assembled condition, the two shell halves cooperatively form a substantially cylindrical, hollow shell having open upper and lower ends with the smaller diameter end of the tapered plug extending a predetermined distance into the upper end and the internally threaded bore of the plug coaxial with the longitudinal axis of the shell.

The bail includes a medial portion extending over the larger diameter, upper end of the plug and a pair of legs extending integrally from opposite ends of the medial portion to terminal ends adjacent which the legs are fixedly attached to the respective shell halves, in accordance with conventional practise. In a first aspect of the invention, the bail legs are uniquely shaped to provide improved maintenance of the shell and plug portions in the most advantageous assembled relation.

In the form of the bail as fabricated, i.e., prior to assembly with the shell and plug, the legs extend from each end of the medial portion along first, linear axes at first, equal, acute angles, outwardly from lines through the junctures of the medial portion and legs and parallel to the bail centerline for a first portion of their length. The legs are bent at this point to extend along second, linear axes at second, equal, acute angles with respect to the same lines for a second portion of their length. The legs are again bent to extend for a third portion of their length, from the junctions with the second portions to terminal ends, along third, linear axes at third, equal, acute angles with respect to the same lines.

The first angles are preferably about 10°, the second angles substantially larger than the first, e.g., about 35°, the third angles are slightly greater than the first, e.g., about 12.5°. The length of the first portions is preferably about double the combined lengths of the second and third portions, and the third portions are preferably more than three times the length of the second portions. When the bail is connected at positions adjacent the terminal end of each leg to the shell halves, and the latter are arranged with their outer surfaces in a cylindrical plane substantially equal in diameter to the drill hole wherein the anchor is to be installed, the third axes of the legs are parallel to the central axis of the shell. Accordingly, the second axes are inclined from the third axes inwardly, toward the central axis, and the first axes are inclined outwardly from the second and slightly inwardly (the difference between the first and third angles) with respect to the aforesaid line through the juncture of the medial and first leg portions and parallel to the central axis.

The configuration of the medial portion of the bail is disclosed in two embodiments. In each embodiment the medial portion includes outer segments extending inwardly from junctures with the legs substantially perpendicularly to the bail centerline. These segments define the uppermost position of the upper end of the plug when the anchor is assembled. In the first embodiment, the central segment of the medial portion is essentially M-shaped, extending upwardly from the plane of the outer segments on each side of the centerline, and downwardly to a position below the plane of the outer segments at the centerline. The upwardly extending parts engage and assist in breaking the resin cartridge as the bolt carrying the anchor is advanced into the drill hole and the central, downwardly extending part engages the bore of the plug when the elements are assembled.

The central segment of the bail medial portion in the second embodiment extends downwardly from each of the outer segmented and is curved about a radius on the bail centerline. In forming the blank for this embodiment of the bail, the material is cut to provide a pair of tabs extending outwardly from what become the outer segments of the medial portion after the blank is bent to form the bail. The tabs are bent to extend upwardly from the outer segments, thereby providing the means for assisting in breaking the resin cartridge.

The foregoing and other features of construction and operation of the invention will be more readily understood and fully appreciated from the following detailed description, taken in conjunction with the accompanying drawings, wherein:

DETAILED DESCRIPTION

Figure 1:
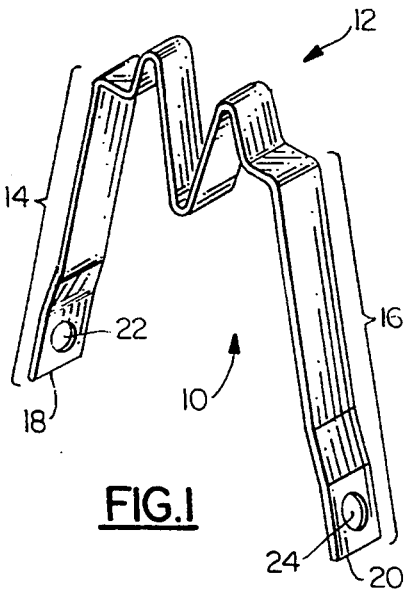
FIG. 1 is a perspective view of a first embodiment of the bail element of the invention.
Figure 2:
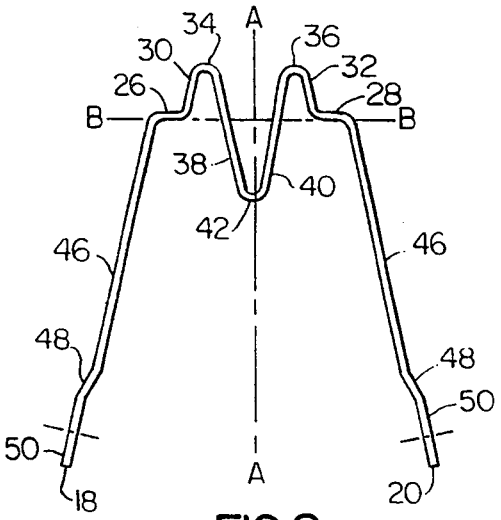
FIG. 2 is a front elevational view of the bail element of FIG. 1.
Figure 3:
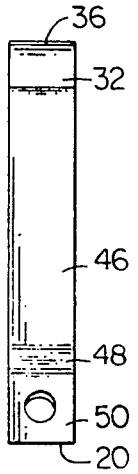
FIG. 3 is a side elevational view of the bail element of FIGS. 1 and 2.

Referring now to the drawings, in FIGS. 1–3 is seen a mine roof expansion anchor bail element, denoted generally by reference numeral 20, embodying the constructional features of the invention. Bail 10 includes the usual medial portion 12 and pair of identical legs 14 and 16 extending integrally from opposite ends of the medial portion to terminal ends 18 and 20, respectively. Through openings 22 and 24 are provided adjacent terminal ends 18 and 20, respectively, for use in attaching bail 10 to the shell portion of the anchor, as described later. Bail 10 is formed from an initially flat blank of a suitable sheet metal, such as CRS ¼ hard Rb 60–75, or HRA, pickled and oiled, ¼ hard Rb 60–75, having a width and thickness of 0.375" and 0.057" respectively Medial portion 12, as best seen in FIG. 2, includes outer segments 26 and 28, extending toward one another from opposite ends of the medial portion at respective junctions with legs 14 and 16 along transverse axis B—B (FIG. 2). At the inner ends of outer segments 26 and 28, medial portion 12 is bent to provide upstanding segments 30 and 32. Outer segments 26 and 28 are perpendicular to and upstanding segments 30 and 32 are inwardly inclined from their junctures with the outer segments toward centerline A—A, on opposite sides of which bail 10 is symmetrical. Upstanding segments 30 and 32 are joined by curved parts 34 and 36 to segments 38 and 40, respectively, which are joined to one another by curved portion 42. Segments 38 and 40 are inwardly inclined with respect to centerline A—A from their junctions with parts 34 and 36 to part 42. Medial portion 12 is bent to form segments 30, 32, 38 and 40, and parts 34, 36 and 42 by bending along axes perpendicular to transverse axis B—B and to centerline A—A.

Figure 4:
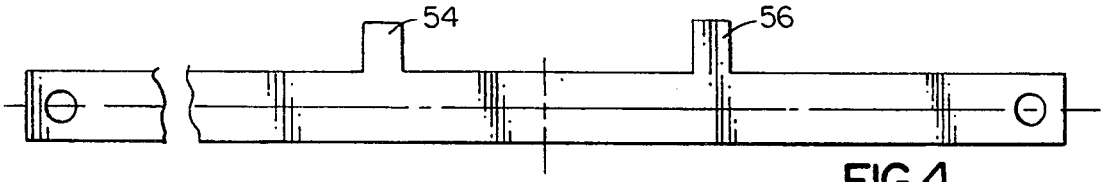
FIG. 4 is a top plan view of a metal blank used to form a second embodiment of the bail element of the invention.
Figure 5:
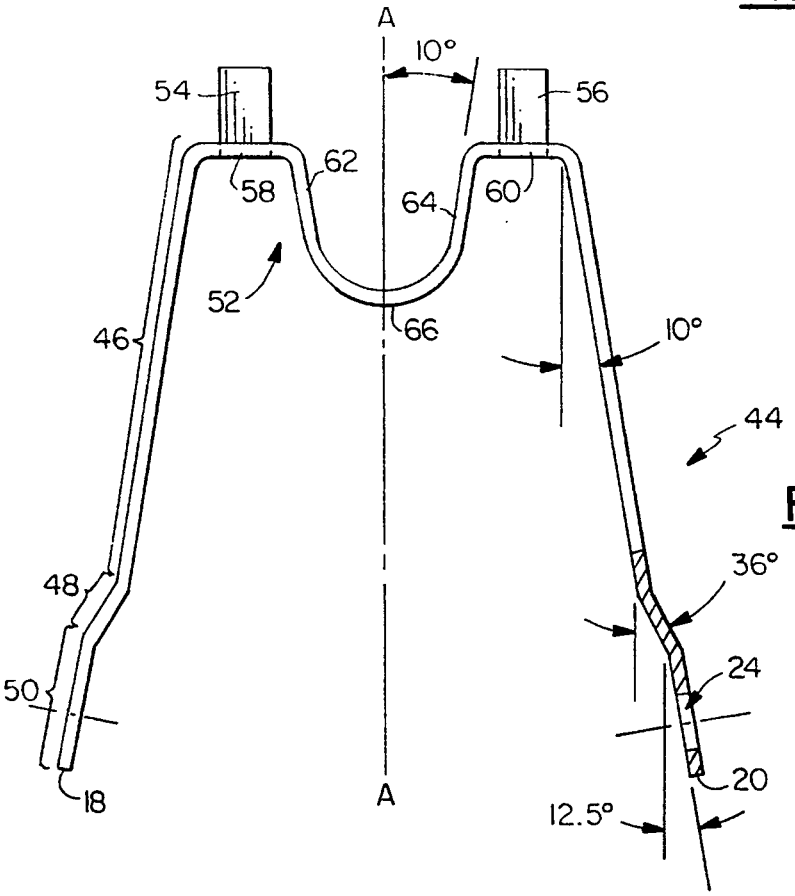
FIG. 5 is a front elevational view of a bail element formed from the blank of FIG. 4.

Legs 14 and 16 are identical to the legs of bail 44, shown in FIG. 5, formed from the flat blank of FIG. 4. Since they are shown to somewhat larger scale, the configuration of the legs of bail 44 will be explained in greater detail, the same reference numerals being used to apply to the legs and parts thereof in both bails 10 and 44. It will be noted that each leg includes three distinct segments. First segments 46 extend from the junctions with opposite ends of the medial portion to a bend forming a junction with second segments 48. A second bend in each leg forms a junction of second segments 48 with third segments 50, which extend to terminal ends 18 and 20.

First segments 46 extend linearly along first axes inclined outwardly at first angles, preferably about 10° and so denoted in FIG. 5, with respect to lines through the junction of the legs with the medial portion and parallel to centerline A—A. Second segments 48 extend linearly along second axes inclined outwardly at second angles, larger than the first, e.g., about 36° with respect to lines parallel to the centerline. Third segments 50 extend linearly along third axes inclined outwardly at third angles, also somewhat larger than the first, but smaller than the second angles, e.g., about 12.5°.

While the legs of bails 10 and 44 are identical, medial portion 52 of bail 44 differs from medial portion 12 of bail 10. It will be noted in FIG. 4 that the blank from which bail 44 is formed includes a pair of outwardly extending tabs 54 and 56. When the blank is bent to form the bail, segments 58 and 60, from which tabs 54 and 56 integrally extend, become the outer segments of medial portion 52, extending linearly inwardly from the junctions of the medial portion with the legs perpendicularly to centerline A—A. Tabs 54 and 56 are bent at their junctures with outer segments 58 and 60 to extend upwardly therefrom. Segments 62 and 64 extend downwardly from respective junctions with outer segments 58 and 60, and are inwardly inclined at preferred angles of 10° with respect to centerline A—A. Uniformly curved segment 66 joins segments 62 and 64.

Figure 6:
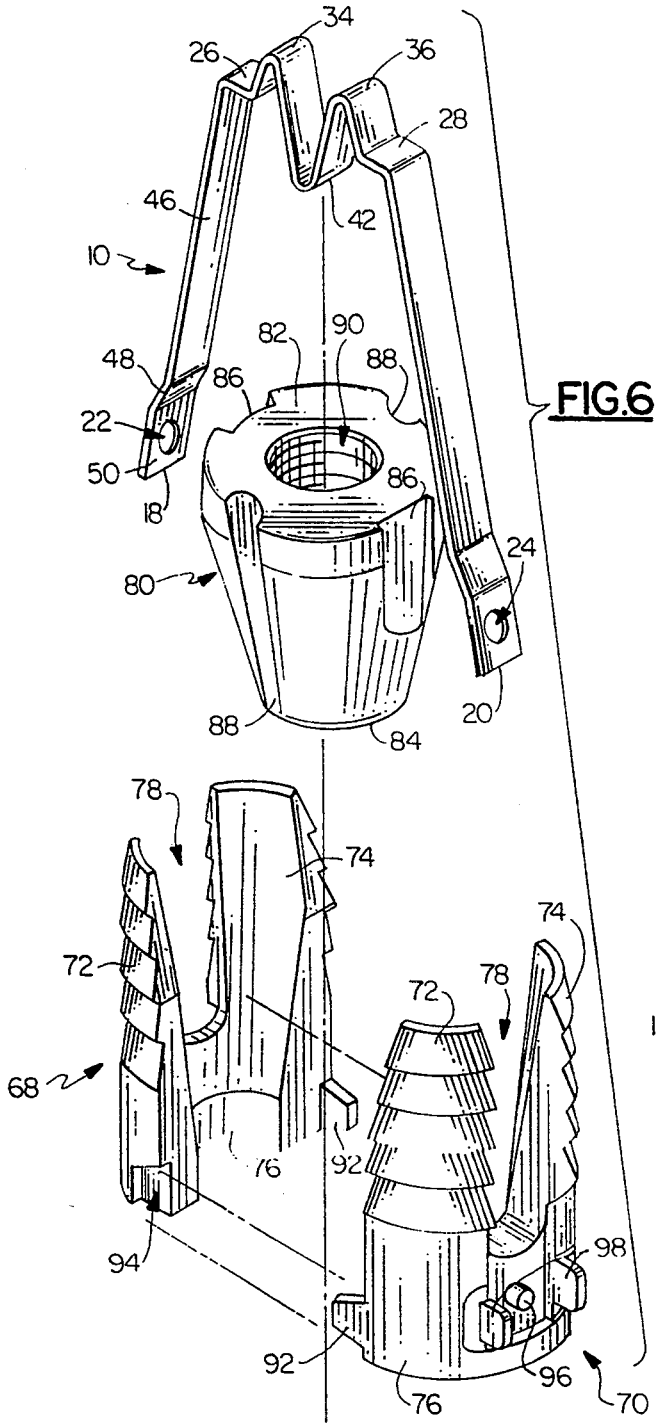
FIG. 6 is an exploded perspective view of a mine roof expansion anchor which includes the bail of FIGS. 1–3.
Figure 7:
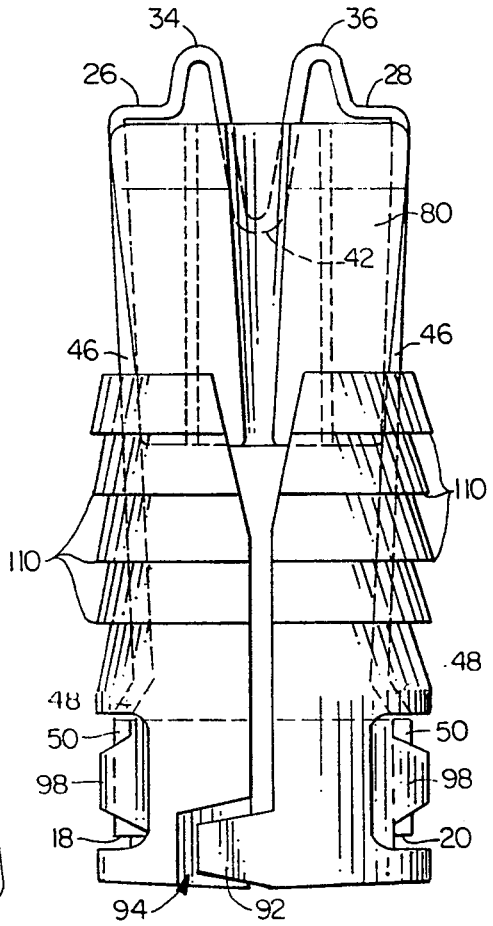
FIG. 7 is a front elevational view of the elements of the anchor of FIG. 6 in assembled condition.

Turning now to FIGS. 6 and 7, bail 10 is shown in exploded perspective and front elevational views, respectively, in relation to other elements of a typical mine roof expansion anchor. The shell portion of the anchor is formed in two, identical, physically separate shell halves 68 and 70. Each shell half includes a pair of leaves or fingers 72 and 74, joined by and extending from base portion 76 and separated by open channels 78. Camming plug 80 tapers from an upper, larger diameter end 82 to a lower, smaller diameter end 84. Grooves 86 extend from upper end 82 part of the distance down opposite sides of the plug, and grooves 88 extend fully down opposite sides offset 90° from grooves 86. Central bore 90 is internally threaded to receive the end of the mine roof bolt.

The anchor is shown in the fully assembled condition in FIG. 7. Shell halves 68 and 70 are in opposed relation with integral tabs 92 on each half overlapping opposing recesses 94 in the other half to cooperatively form a radially expansible shell portion symmetrical about a central axis. Plug 80 is placed with its smaller diameter end 84 extending into the upper end of the shell portion by a distance determined by the relative dimensions of the shell and plug. Bail 10 is positioned with medial portion 12 extending over upper end 82 of the plug and legs 14 and 16 extending through shell channels 78 and studs 96 on each shell half (stud 96 on shell half 70 being shown in FIG. 6) extending through openings 22 and 24 in the bail legs. Assembly is completed by peening studs 96 and bending ears 98 over the bail legs adjacent their terminal ends.

It will be noted that in the assembled condition, with the shell halves symmetrically positioned about the central axis, bail leg segments 50 are substantially parallel to one another (and to the central axis), extending down the outer surfaces of shell base portions 76. This means, of course, that the bail legs are moved inwardly from the positions in which they are formed. Since the bail is made of springy sheet metal, the bail legs in the assembled condition exert an outward biasing force on the shell halves. It is the usual practise to maintain the shell halves in the position of FIG. 7, prior to insertion of the anchor into the drill hole, with a plastic sleeve, not shown in the present application, having any of a number of prior art configurations. With the angular values of the leg segments previously given, placing segments 50 with their axes parallel to the central axis causes second segments 48 to extend inwardly, toward the central axis, over base portions 76 and through channels 78. Also, since the third axes extend outwardly at angles greater than those of the first axes in the undeformed bail, first segments 46 are inclined slightly inwardly from upper to lower ends.

Figure 8:
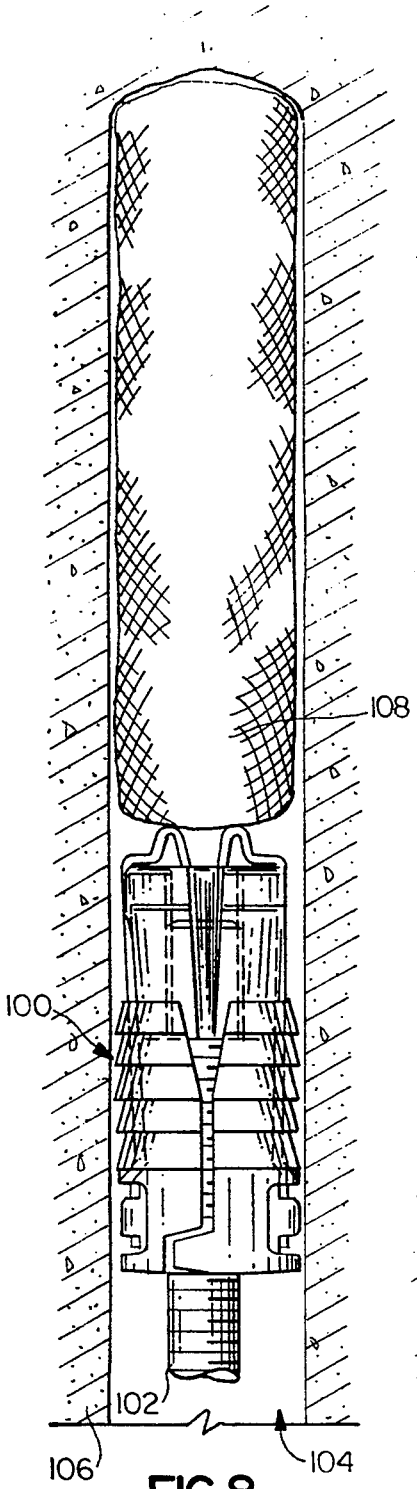
FIG. 8 is a side elevational view of the anchor of FIG. 7, shown in a drill hole with a resin cartridge and a mine roof bolt during a preliminary stage of installation.
Figure 9:
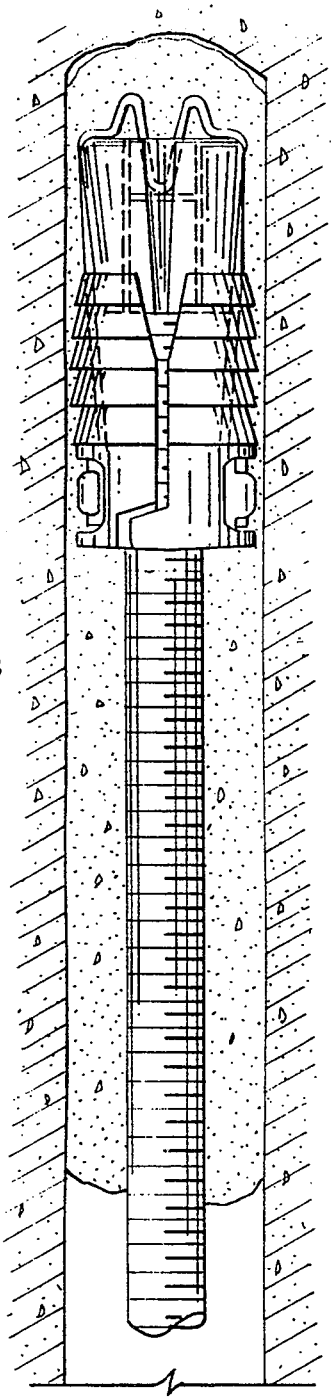
FIG. 9 is the same view as FIG. 8, showing the bolt and anchor fully inserted in the drill hole.
Figure 10:
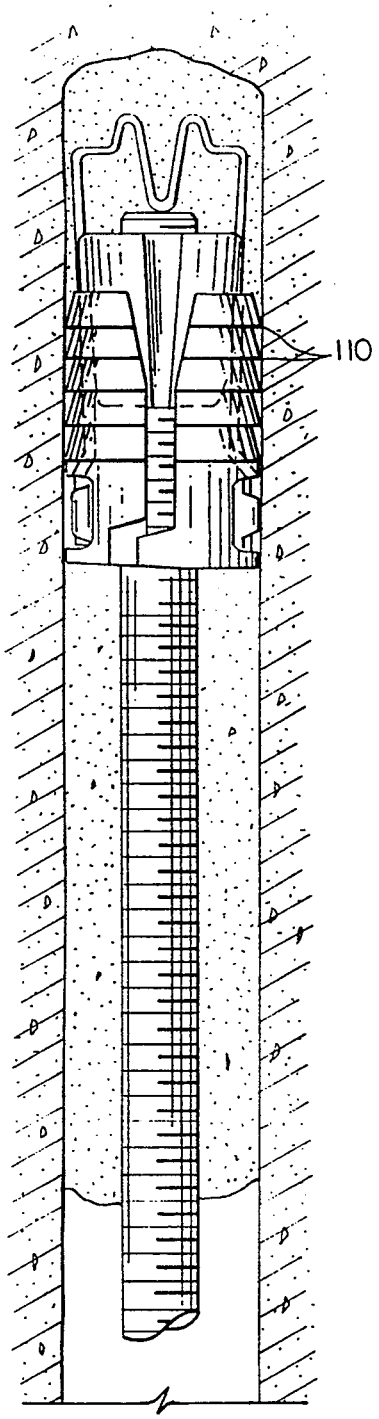
FIG. 10 is the same view as FIGS. 8 and 9, showing the elements in the fully installed condition.

Turning now to FIGS. 8–10, the anchor of FIG. 7 is shown in a sequence of positions involved in its installation. The anchor, denoted generally by reference numeral 100, is carried on the threaded end of bolt 102 which is advanced into the threadedly mating bore of plug 80 until the upper end of the bolt contacts bail part 42. After bore hole 104 is drilled in rock formation 106, resin cartridge 108 is inserted, ahead of anchor 100, and bolt 102 is advanced into the hole. Cartridge 108 is a conventional package having two compartments which isolate the components of a two-part resin grouting material until the cartridge is broken.

The elements are shown in FIG. 8 when cartridge 108 has reached the blind end of hole 104. It will be noted that the lower end of cartridge 108 rests upon upstanding, curved parts 34 and 36 of bail medial portion 12. Continued, axial advance of bolt 102, from the position of FIG. 8 to that of FIG. 9, breaks cartridge 108, releasing and permitting mixing of the components. Piercing of the cartridge by parts 34 and 36, or, when an anchor incorporating bail 44 is employed, by tabs 54 and 56, facilitates breakage and release of the components.

The lower end of bolt 102 is not shown, but remains outside the hole, having a head or other means for engagement by a power wrench in accordance with conventional practise. The lower end of the bolt carries a bearing plate, as is also conventional, which engages the surface of rock formation 106 about the entrance to hole 104 to define the fully inserted position of the bolt. Torque is then applied to bolt 102, causing plug 80 to move axially down the threaded end of the bolt to expand shell portion 68 radially as the elements move from the position of FIG. 9 to FIG. 10.

Rotation of the shell and plug portions is inhibited by frictional engagement of serrations 110 on the outer surfaces of fingers 72 and 74 with the wall of drill hole 104. Sufficient torque is applied to ensure firm anchorage and to apply a desired degree of tension to bolt 102. Bolt rotation aids in completing mixing of the resin components, which surround portions of the anchor and bolt and quickly harden to enhance the strength and permanence of the anchorage. As plug 80 travels down the bolt threads a downward, as well as radially outward force is applied to shell halves 68 and 70, and thus to the bail. It will be understood that the bail is often somewhat distorted by this force, as well as by any elongation of the bolt due to tensioning, although the bail is shown in FIG. 10 in an undeformed condition.

In summary, the bail element of the invention, due to the plurality of angular bends in the legs, providing three linear segments in each leg, ensures that the bail is firmly secured about the plug. Additionally, and equally importantly, the design ensures that the bail, when assembled with the other anchor elements, is entirely within the cylindrical plane defined by the shell serrations. Furthermore, the bail medial portion includes inwardly extending segments initially contacting the upper end of the plug, upstanding parts or tabs which contact and pierce a resin cartridge used with the anchor, and a central part extending downwardly into the plug bore. This permits the bail to pierce and break the resin cartridge with less force than is typically required when using combined mechanical-resin anchoring means. The upstanding parts or tabs and the central part preferably extend for at least about $\frac{1}{4}''$ and $\frac{1}{2}''$, respectively, on opposite sides of transverse axis B—B.

What is claimed is:

1. A bail element formed of a unitary blank of springy sheet metal for maintaining shell and plug portions of a mine roof expansion anchor in assembled relation prior to installation, said bail element comprising:

a) a medial portion of predetermined length having first and second ends;

b) a pair of substantially identical legs extending integrally from respective first junctures with said first and second ends of said medial portion to terminal ends, symmetrically with respect to a centerline through said medial portion, both of said legs lying entirely on one side of a line through said first junctures;

c) each of said legs including integral, first, second and third segments having a configuration in an undeformed condition relative to one another and to said medial portion such that:

i) said first segments extend from said first junctures along respective, first, linear axes to second junctures of said first segments with said second segments;

ii) said second segments extend from said second junctures along respective, second, linear axes to third junctures of said second segments with said third segments;

iii) said third segments extend from said third junctures along respective, third, linear axes to said terminal ends;

iv) said first, second and third axes extending outwardly at respective first, second and third acute angles with respect to said centerline, said first and third angles each being less than about 15° and said second angle being substantially greater than said first and third angles; and v) said first segment having a length greater than the combined length of said second and third segments;

vi) said second junctures being spaced a greater distance from said centerline than said first junctures;

vii) said third junctures being spaced a greater distance from said centerline than said second junctures;

viii) said terminal ends being spaced a greater distance from said centerline than said third junctures; and d) said medial portion including outer segments extending inwardly from said first junctures along a fourth axis substantially perpendicular to said centerline, a pair of laterally spaced parts extending from said fourth axis in a direction generally opposite the direction in which said legs extend from said first junctures, and a central part extending from said fourth axis in generally the same direction in which said legs extend from said first junctures.

2. The bail element of claim 1 wherein said first angle is about 10° and said second angle is about 12.5°.

3. The bail element of claim 2 wherein said second angle is about 36°.

4. The bail element of claim 1 wherein said first segment has a length about twice the combined length of said first and second segments.

5. The bail element of claim 4 wherein said first angle is about 10°, said second angle is about 36° and said third angle is about 12.5°.

6. The bail element of claim 1 wherein said pair of parts extend integrally from said outer segments on opposite lateral sides of said central part.

7. The bail element of claim 1 wherein said pair of parts are formed by tabs integral with said outer segments and bent at junctures of said tabs and outer segments to extend away from said fourth axis in a direction generally opposite to the direction in which said legs extend from said first junctures.

8. A bail element for maintaining shell and plug portions of a mine roof expansion anchor in assembled relation prior to installation and for assisting in breaking a resin cartridge utilized together with said expansion anchor in a drill hole to secure a mine roof bolt therein, said bail element comprising:

a) a medial portion extending between opposite ends along a transverse axis, and having a centerline perpendicularly intersecting said transverse axis;

b) a pair of legs extending from respective first junctures with said opposite ends, away from and on the same, first side of said transverse axis and on opposite sides of said centerline; and c) said medial portion including:

i) a pair of outer segments extending inwardly from said first junctures along said transverse axis toward said centerline;

ii) a pair of parts extending from respective second junctures with said outer segments, away from and on the same, second side of said transverse axis, and on opposite sides of said centerline; and iii) a central part extending away from said transverse axis on said first side thereof and bisected by said centerline.

9. The bail element of claim 8 wherein said bail is formed from a blank of sheet metal having a constant, predetermined width over its entire length, and said pair of parts and said central part are formed by bending said medial portion.

10. The bail element of claim 9 wherein said pair of parts extend away from said transverse axis for a distance of at least about $\frac{1}{4}''$.

11. The bail element of claim 10 wherein said central part extends away from said transverse axis on said first side thereof for a distance of at least about $\frac{1}{2}''$.

12. The bail element of claim 8 wherein said pair of parts are formed by tabs extending integrally from said medial portion.

13. The bail element of claim 12 wherein said tabs extend integrally from said outer segments.

14. The bail element of claim 13 wherein said tabs extend from said outer segments for a distance of at least about $\frac{1}{4}''$.

15. The bail element of claim 8 wherein said legs are substantially identical, each having first, second and third, linear segments, said first segments extending from first junctures with said medial portion opposite ends to second junctures with said second segments, thence to third junctions of said second with said third segments, thence to terminal ends.

16. The bail element of claim 15 and further including a through opening adjacent each of said terminal ends to facilitate attachment of said bail element to said anchor shell portion.

17. A mine roof expansion anchor assembly comprising:

a) a tapered plug having respective larger and smaller diameter ends, and an internally threaded, through, central bore;

b) a hollow, generally cylindrical shell portion having upper and lower ends and substantially symmetrical about a central, longitudinal axis, said plug smaller end extending into said shell portion upper end, said shell portion further having at least two pairs of fingers extending integrally from base structure at said lower end, said fingers of each pair being separated by open channels; and c) a bail element having a centerline substantially coincident with said central axis, a medial portion extending between opposite ends over said larger diameter end of said plug with at least a portion of said medial portion contacting said plug, and a pair of substantially identical legs respectively extending from first junctures with said medial portion opposite ends, down opposite sides of said plug, through said channels on opposite sides of said shell portion and fixedly attached to said base structure, said legs having;

i) first segments extending from said first junctures along respective, first, linear axes inwardly inclined from said first junctures toward said central axis;

ii) second segments extending from second junctures with said first segments along respective, second, linear axes outwardly inclined from said second junctures away from said central axis; and iii) third segments extending from third junctures with said second segments along respective, third, linear axes substantially parallel to said central axis, to terminal ends all of said bail element lying within a cylinder defined by the outermost surfaces of said shell portion;

said first junctures being spaced a greater distance from said centerline than said second junctures;

said third junctures being spaced a greater distance from said centerline than said second junctures.

18. The anchor assembly of claim 17 wherein said shell portion comprises a pair of physically separate, substantially identical shell halves each including a pair of said fingers and integral, base portions having inner and outer surfaces, said legs being fixedly attached to said base portion outer surfaces.

19. The anchor assembly of claim 18 wherein said first segments of said legs extend from said medial portion substantially to said shell base portions.

20. The anchor assembly of claim 19 wherein said medial portion includes outer segments extending inwardly from said opposite ends in contact with said larger diameter end of said plug.

21. The anchor assembly of claim 20 wherein said medial portion further includes a laterally spaced pair of parts extending in a direction away from said plug.

22. The anchor assembly of claim 21 wherein said pair of parts extend away from said plug for a distance of at least about ¼".

23. The assembly of claim 21 wherein said pair of parts are formed by bends in said medial portion inwardly of said opposite ends of said outer segments.

24. The assembly of claim 21 wherein said pair of parts are formed by tabs integral with said outer segments and bent at junctures of said tabs and outer segments.

25. The assembly of claim 21 wherein said medial portion further includes a central part between said outer segments extending into said plug bore.

26. The assembly of claim 17 wherein said bail is formed from springy sheet metal with each of said first, second and third segments extending outwardly at first, second and third respective angles with respect to said centerline in the undeformed condition, said legs being held with said first and second linear axes inclined inwardly and outwardly, respectively, and said third linear axis substantially parallel with respect to said central axis by fixed attachment of said legs to said base structure.

27. The assembly of claim 26 wherein said second angle is greater than both said first and third angles.

28. The assembly of claim 27 wherein said third angle is greater than said first angle.

29. The assembly of claim 28 wherein said first, second and third angles are about 10°, 36° and 12.5°, respectively.

* * * * *